US010165372B2

(12) United States Patent
Dyrlund

(10) Patent No.: US 10,165,372 B2
(45) Date of Patent: Dec. 25, 2018

(54) SOUND SYSTEM FOR TINNITUS RELIEF

(75) Inventor: Ole Dyrlund, Virum (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 13/538,750

(22) Filed: Jun. 29, 2012

(65) Prior Publication Data

US 2013/0343581 A1 Dec. 26, 2013

(30) Foreign Application Priority Data

Jun. 26, 2012 (DK) ..... 2012 70372
Jun. 26, 2012 (EP) ..... 12173634

(51) Int. Cl.
*H04R 25/00* (2006.01)

(52) U.S. Cl.
CPC ..... *H04R 25/00* (2013.01); *H04R 25/75* (2013.01)

(58) Field of Classification Search
CPC ..... H04R 25/00; H04R 25/75
USPC ..... 381/312
See application file for complete search history.

(56) References Cited

U.S. PATENT DOCUMENTS 4,052,564 A * 10/1977 Probst et al. ..... 381/73.1
4,170,764 A * 10/1979 Salz et al. ..... 332/100
4,335,710 A 6/1982 Williamson
4,759,070 A 7/1988 Voroba et al.
4,870,688 A * 9/1989 Voroba ..... G09B 21/009 381/322
4,887,299 A 12/1989 Cummins et al.
5,384,853 A * 1/1995 Kinoshita et al. ..... 381/71.12
5,403,262 A 4/1995 Gooch
5,521,325 A 5/1996 Takeuchi et al.
5,795,287 A 8/1998 Ball
6,047,074 A * 4/2000 Zoels et al. ..... 381/313
6,048,305 A 4/2000 Bauman et al.
6,307,893 B1 10/2001 Bremer et al.
6,816,599 B2 * 11/2004 Thiede ..... G10H 1/26 381/314
6,846,284 B2 1/2005 Choy
(Continued)

FOREIGN PATENT DOCUMENTS

CN 1813491 A 8/2006
CN 101637420 A 2/2010
(Continued)

OTHER PUBLICATIONS

First Technical Examination and Search Report dated Dec. 21, 2012, for DK Patent Application No. PA 2012 70372.
(Continued)

*Primary Examiner* — Sean H Nguyen
(74) *Attorney, Agent, or Firm* — Vista IP Law Group, LLP

(57) ABSTRACT

A sound enrichment system for provision of tinnitus relief to a user, the sound enrichment system includes: a signal generator for provision of a carrier signal; at least one signal modulator including a first signal modulator for modulation of the carrier signal to a modulated signal; an output transducer for conversion of the modulated signal to an acoustic signal for presentation to the user; and a memory configured to store at least one feature including a first feature; wherein the at least one signal modulator is configured to modulate the carrier signal according to the at least one feature such that the acoustic signal converted from the modulated signal resembles a natural sound signal for the user.

80 Claims, 5 Drawing Sheets

(56) References Cited

U.S. PATENT DOCUMENTS

Figure 1:
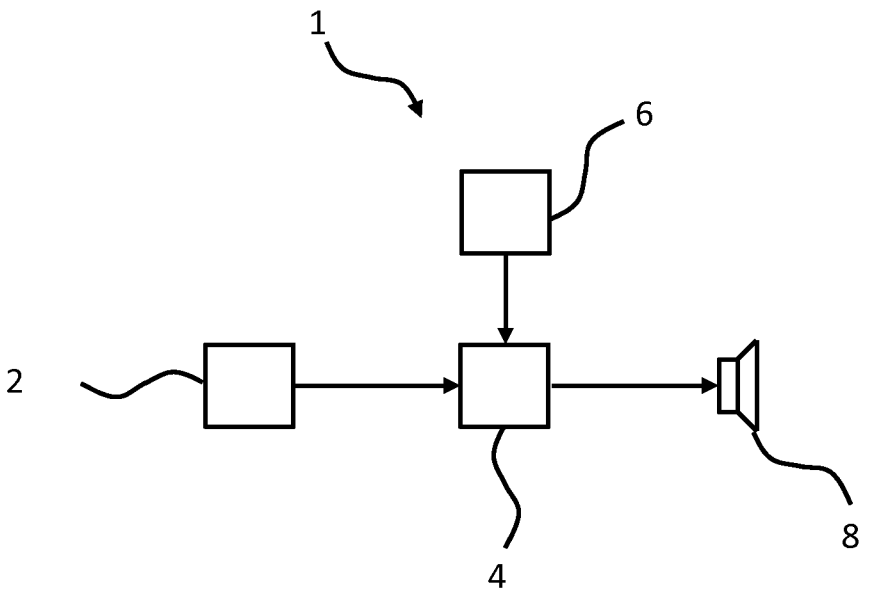

| | | | | |
|---|---|---|---|---|
| 6,901,362 | B1 | 5/2005 | Jiang et al. | |
| 7,995,770 | B1 * | 8/2011 | Simon | 381/82 |
| 7,995,771 | B1 | 8/2011 | Faltys | |
| 8,043,203 | B2 * | 10/2011 | Park et al. | 600/25 |
| 8,249,275 | B1 * | 8/2012 | Tsang | H03F 1/305 330/129 |
| 8,801,592 | B2 | 8/2014 | Jensen | |
| 2001/0051776 | A1 | 12/2001 | Lenhardt | |
| 2002/0090100 | A1 | 7/2002 | Thiede et al. | |
| 2002/0191799 | A1 | 12/2002 | Nordqvist et al. | |
| 2004/0131200 | A1 | 7/2004 | Davis | |
| 2004/0136542 | A1 | 7/2004 | Denda | |
| 2004/0183690 | A1 | 9/2004 | Nakagawa et al. | |
| 2006/0167335 | A1 | 7/2006 | Park et al. | |
| 2006/0227018 | A1 * | 10/2006 | Ejima | G10L 21/038 341/50 |
| 2006/0233407 | A1 | 10/2006 | Steinbuss | |
| 2007/0009126 | A1 | 1/2007 | Fischer | |
| 2007/0064956 | A1 * | 3/2007 | Iwata | G10L 21/038 381/61 |
| 2007/0081680 | A1 * | 4/2007 | Yen | 381/182 |
| 2007/0121976 | A1 * | 5/2007 | Pedersen et al. | 381/314 |
| 2007/0127755 | A1 | 6/2007 | Bauman | |
| 2007/0133832 | A1 | 6/2007 | DiGiovanni | |
| 2007/0270920 | A1 * | 11/2007 | Turner | A61B 5/121 607/55 |
| 2008/0080719 | A1 * | 4/2008 | Ahn et al. | 381/17 |
| 2008/0170719 | A1 * | 7/2008 | Shimura et al. | 381/94.1 |
| 2009/0028352 | A1 * | 1/2009 | Petroff | 381/61 |
| 2009/0028353 | A1 | 1/2009 | Petroff | |
| 2009/0030321 | A1 * | 1/2009 | Baba et al. | 600/454 |
| 2009/0208030 | A1 * | 8/2009 | Anderson et al. | 381/73.1 |
| 2009/0270673 | A1 | 10/2009 | Abolfathi et al. | |
| 2010/0008526 | A1 | 1/2010 | de Vries et al. | |
| 2011/0054241 | A1 * | 3/2011 | Jensen | 600/28 |
| 2011/0071340 | A1 * | 3/2011 | McGuire | 600/28 |
| 2011/0150257 | A1 * | 6/2011 | Jensen | H04R 25/453 381/318 |
| 2012/0219169 | A1 * | 8/2012 | Tong et al. | 381/332 |
| 2013/0202119 | A1 * | 8/2013 | Thiede | A61B 5/0482 381/23.1 |
| 2013/0243227 | A1 * | 9/2013 | Kinsbergen | H04M 1/2475 381/314 |

FOREIGN PATENT DOCUMENTS

| | | | |
|---|---|---|---|
| CN | 101641967 | A | 2/2010 |
| CN | 101641968 | A | 2/2010 |
| CN | 102075842 | A | 5/2011 |
| CN | 102462583 | A | 5/2012 |
| DE | 4427216 | A1 | 2/1996 |
| DE | 29718503 | U1 | 4/1999 |
| EP | 0820211 | A1 | 1/1998 |
| EP | 1205904 | A1 | 5/2002 |
| EP | 2 132 957 | | 11/2010 |
| EP | 2 132 957 | B1 | 11/2010 |
| EP | 1 658 754 | B1 | 10/2011 |
| GB | 2134689 | A | 8/1984 |
| GB | 2235349 | | 2/1991 |
| JP | S62-032427 | A | 2/1987 |
| JP | H05-023396 | | 2/1993 |
| JP | 06204749 | | 7/1994 |
| JP | 10-80000 | A | 3/1998 |
| JP | 2004-070267 | A | 3/2004 |
| JP | 2004-513725 | | 5/2004 |
| JP | 2005519686 | A | 7/2005 |
| JP | 2008-264681 | A | 11/2008 |
| JP | 2009-049959 | A | 3/2009 |
| JP | 2010-520683 | A | 6/2010 |
| JP | 2014-007740 | A | 1/2014 |
| WO | WO 9600051 | | 1/1996 |
| WO | WO 9907302 | | 2/1999 |
| WO | WO 0176321 | | 10/2001 |
| WO | WO 0241296 | A1 | 5/2002 |
| WO | WO03077511 | | 9/2003 |
| WO | WO 2004098690 | | 11/2004 |
| WO | WO 2006030373 | | 3/2006 |
| WO | 2008/106974 | A2 | 9/2008 |
| WO | WO 2008/106974 | A2 | 9/2008 |
| WO | WO 2008106975 | | 9/2008 |
| WO | WO 2008/134345 | A1 | 11/2008 |

OTHER PUBLICATIONS

Extended European Search Report dated Nov. 28 2012, for EP Patent Application No. 12173634.2.

Japanese Office Action dated Jun. 3, 2014, for related JP Patent Application No. 2013-118760, 2 pages.

Office Action for JP Patent Application No. 2013-118760, dated Feb. 4, 2014 (4 pages).

Notification of Reason for Rejection dated Sep. 24, 2015, for corresponding Japanese Patent Application No. 2014-203803, 11 pages.

Notification of Reason for Rejection dated Jul. 28, 2015, for corresponding Japanese Patent Application No. 2014-19816, 7 pages.

First Technical Examination dated Aug. 19, 2015, for corresponding Danish Utility Model Application No. BA 2015 00084, 4 pages.

First Technical Examination dated Aug. 21, 2015, for corresponding Danish Utility Model Application No. BA 2015 00085, 4 pages.

International Search Report for related International Application No. PCT/DK2008/000094 dated Aug. 18, 2008.

Written Opinion of the International Searching Authority for International Application No. PCT/DK2008/000094 dated Aug. 18, 2008.

International Search Report for International Application No. PCT/DK2008/000093 dated Oct. 13, 2008.

Written Opinion of the International Searching Authority for International Application No. PCT/DK2008/000093 dated Oct. 13, 2008.

Pawel J. Jastreboff, Tinnitus Habituation Therapy (THT) and Tinnitus Retraining Theraphy (TRT). In Tyler Rs, ed. Handbook of Tinnitus, San Diego: Singular Publishing, 2000, pp. 357-376.

Luca Del Bo et al, "Using Open-Ear Hearing Aids in Tinnitus Theraphy" BTE and Open Hearing Aid Fittings: Hearing Research, Hearing Review, Aug. 2006.

Danish Examination Report dated Oct. 11, 2007, for Danish Patent Application No. PA 2007 00346.

Japanese Notice of Reason for Refusal and Written Directive dated Aug. 28, 2012, for Japanese Patent Application No. 2009-552065 (w/ English Translation).

Chinese Office Action dated Apr. 30, 2014 for related Chinese Patent App. No. 200880007383.8, 19 pages.

First Chinese Office Action dated May 26, 2016 for related Chinese Patent Application No. 2013-10674848.8.

Second Technical Examination dated Jun. 21, 2016 for corresponding Chinese Patent Application No. PA 2013 10253433.3.

Extended European Search Report dated Apr. 21, 2016 for corresponding EP Patent Application No. 15199421.7, 10 pages.

Japanese Decision of Rejection dated Apr. 5, 2016 for corresponding JP Patent Application No. 2014-203803.

Second Technical Examination dated Jun. 21, 2016 for related Chinese Patent Application No. 201310253433.3 (English Translation not provided, see statement of relevance submitted herewith).

Japanese Office Action for related JP Patent Application No. 2013-118760 dated Feb. 4, 2014, 2 pages (English Translation not provided, see statement of relevance submitted herewith).

Japanese Office Action dated Jun. 3, 2014 for related JP Patent Application No. 2013-118760, 2 pages (English Translation not provided, see statement of relevance submitted herewith).

First Technical Examination dated Aug. 19, 2015, for corresponding Danish Utility Model Application No. BA 2015 00084, 4 pages (English Translation not provided, see statement of relevance submitted herewith).

First Technical Examination dated Aug. 21, 2015, for corresponding Danish Utility Model Application No. BA 2015 00085, 4 pages (English Translation not provided, see statement of relevance submitted herewith).

(56) References Cited

OTHER PUBLICATIONS

First Office Action dated Nov. 4, 2015, for related Chinese Patent Application No. 201310253433.3 (English Translation not provided, see statement of relevance submitted herewith).
Communication pursuant to Article 94(3) EPC dated Aug. 28, 2017 for corresponding European Patent Application No. 15199421.7, 7 pages.
Anonymous: "Natural Sounds"—Wikipedia, May 19, 2012, 4 pages.
Second technical examination, Intention to Grant dated Jun. 26, 2013 for DK Patent Application No. PA 2012 70372, 2 pages.
First Office Action dated Nov. 4, 2015, for corresponding Chinese Patent Application No. 201310253433.3.

* cited by examiner

SOUND SYSTEM FOR TINNITUS RELIEF

RELATED APPLICATION DATA

This application claims priority to and the benefit of Danish Patent Application No. PA 2012 70372, filed on Jun. 26, 2012, pending, and European Patent Application No. 12173634.2, filed on Jun. 26, 2012, pending, the disclosures of both of which are expressly incorporated by reference in their entireties herein.

FIELD

An embodiment described herein relates to a sound enrichment system for the provision of tinnitus relief. Another embodiment described herein relates to a hearing aid with a sound enrichment system for the provision of tinnitus relief. A further embodiment described herein relates to a binaural hearing aid system with a sound enrichment system for the provision of tinnitus relief.

BACKGROUND

Tinnitus is the perception of sound in the human ear in the absence of corresponding external sound(s). Tinnitus is considered a phantom sound, which arises in the auditory system. For example, a ringing, buzzing, whistling, or roaring sound may be perceived as tinnitus. Tinnitus can be continuous or intermittent, and in either case can be very disturbing, and can significantly decrease the quality of life for one who has such an affliction.

Tinnitus can, to date, not be surgically corrected and since, to date, there are no approved effective drug treatments, so-called tinnitus maskers have become known. These are small, battery-driven devices which are worn like a hearing aid behind or in the ear and which, by means of artificial sounds which are emitted, for example, via a hearing aid speaker into the auditory canal, to thereby psycho acoustically mask the tinnitus and thus reduce the tinnitus perception.

Although present day tinnitus maskers to a certain extent may provide immediate relief of tinnitus, the masking sound produced by them is very monotonous and therefore unpleasant for the user of such a masker. Investigations show that tinnitus is a condition that requires long term treatment in order to achieve good results. However, the listening to highly monotonic sounds signals as masking sounds during such a long time may be a severe annoyance to a user of such a masker.

An example of a present day tinnitus masker is disclosed in EP 2 132 957 where a noise signal is random or pseudo randomly modulated.

Another example is disclosed in US 2009/0028352 where a recorded natural sound is combined with a computer generated sound. The computer generated sound emulates the recorded sound. The combined sound has greater ratios between minimum and maximum amplitude envelopes compared to the recorded natural signal.

SUMMARY

It is an object of the present disclosure to provide improved tinnitus relief in a sound enrichment system with a reduced or minimum use of memory.

Accordingly, a sound enrichment system for provision of tinnitus relief to a user is provided, the sound enrichment system comprising a signal generator for provision of a carrier signal and at least one signal modulator including a first signal modulator for modulation of the carrier signal to a modulated signal. The sound enrichment system comprises an output transducer for conversion of the modulated signal to an acoustic signal. The acoustic signal is presented to the user during use of the sound enrichment system. The sound enrichment system may comprise a memory configured to store at least one feature including a first feature, and the at least one signal modulator is configured to modulate the carrier signal according to the at least one feature. The carrier signal may be modulated such that the modulated signal is perceived as a natural sound signal by the user during use.

The modulated signal may have a first sound pressure level $P_1$ at a first frequency $f_1$ and a second sound pressure level $P_2$ less than the first pressure level $P_1$ at a second frequency $f_2$ larger than the first frequency $f_1$.

Further disclosed is a method for provision of tinnitus relief to a user, the method comprising generating a carrier signal in a sound enrichment system worn by the user; modulating the carrier signal with at least one feature including a first feature thereby forming a modulated signal; converting the modulated signal to an acoustic signal and presenting the acoustic signal to the user; wherein modulating the carrier signal comprises retrieving the least one feature from a memory of the sound enrichment system, and wherein the modulated signal is perceived as a natural sound signal by the user during use.

The modulated signal may have a first sound pressure level at a first frequency and a second sound pressure level less than the first pressure level at a second frequency larger than the first frequency.

The modulated signal may have a first sound pressure level $P_1$ in a first frequency band $F_1$ and a second sound pressure level $P_2$ less than the first pressure level $P_1$ in a second frequency band $F_2$ with frequencies larger than the frequencies of the first frequency band $F_1$. The sound pressure level of a frequency band may be defined as the average sound pressure level for frequencies of the frequency band.

The signal modulator is configured to modulate the carrier signal with at least one feature including a first feature. The modulated signal may correspond to, resemble or be similar to a natural sound signal.

The sound pressure level of the modulated signal may be a substantially decreasing function of frequency for frequencies larger than a first threshold frequency. The first threshold frequency may be about 1 kHz or about 2 kHz.

The sound pressure level of the modulated signal may be a substantially increasing function of frequency for frequencies smaller than a second threshold frequency. The second threshold frequency may be about 100 Hz, 125 Hz or about 250 Hz. The first threshold frequency may be larger than the second threshold frequency.

The sound pressure level of the modulated signal may have a local minimum at selected frequencies. In one or more embodiments, the sound pressure level has a local minimum at about 125 Hz.

In one or more embodiments, the first threshold frequency is about 8 kHz and the sound pressure level has a local minimum at about 4 kHz.

The at least one signal modulator comprises a first signal modulator and optionally a second signal modulator and/or a third signal modulator. The at least one signal, e.g. the first signal modulator and/or the second signal modulator may be configured to modulate the carrier signal by amplitude modulation and/or frequency modulation.

A natural sound signal is a sound signal that appears in nature. Such signals found in nature can be sounds from an animal, a group of animals or sound from a natural phenomenon. Examples of a natural sound signal is the tile sound of flowing water, breaking waves, a waterfall, the sound of a rainforest and the like. A natural sound signal may be characterized by having a wide band energy spectrum, e.g. in the order of at least 1 kHz.

The modulated signal may have an energy spectrum with a width of at least 1 kHz, such as in the range from 1 to 8 kHz.

The first frequency $f_1$ may be in the intermediate frequency band or in the high frequency band. In one or more exemplary embodiments, the first frequency $f_1$ is 1 kHz or 2 kHz.

The second frequency $f_2$ may be in the intermediate frequency band or in the high frequency band. In one or more exemplary embodiments, the second frequency $f_2$ is 4 kHz or 8 kHz.

The third frequency $f_3$ may be in the intermediate frequency band or in the high frequency band. In one or more exemplary embodiments, the third frequency $f_3$ is 8 kHz or 12 kHz.

The intermediate frequency band may include frequencies in the range from 1 kHz to 4 kHz.

The high frequency band may include frequencies in the range from 4 kHz to 20 kHz.

The first frequency band $F_1$ may include frequencies in the range from 1 kHz to 4 kHz.

The second frequency band $F_2$ may include frequencies in the range from 4 kHz to 20 kHz.

The third frequency band $F_3$ may include frequencies in the range from 4 kHz to 20 kHz.

The first frequency band $F_1$ may comprise the first frequency $f_1$ and/or the second frequency $f_2$. In one or more embodiments, the first frequency band comprises the third frequency $f_3$.

The second frequency band $F_2$ may comprise the first frequency $f_1$ and/or the second frequency $f_2$. In one or more embodiments, the second frequency band comprises the third frequency $f_3$.

The third frequency band $F_3$ may comprise the first frequency $f_1$ and/or the second frequency $f_2$. In one or more embodiments, the third frequency band comprises the third frequency $f_3$.

The first feature may comprise amplitude modulation parameters indicative of a natural sound signal. The first feature may comprise spectral parameters or frequency modulation parameters. A feature may comprise a gain value or other value indicative of the sound pressure level of the modulated signal or part thereof being modulated with the respective feature. For example, the first feature may comprise a first gain $G_1$ or other value indicative of the sound pressure level of the modulated signal in a first frequency band $F_1$ or at selected frequency or frequencies.

The at least one feature may comprise a second feature, e.g. a second feature comprising amplitude modulation parameters of a natural sound signal. The second feature may comprise spectral parameters or frequency modulation parameters. The second feature may comprise a second gain $G_2$ or other value indicative of the sound pressure level of the modulated signal in a second frequency band $F_2$ or at selected frequency or frequencies.

The frequency modulation parameters may comprise one or more spectral characteristics of a natural sound signal, such as the frequency spectrum mean, the frequency spectrum variance, spectrum distribution etc.

The first signal modulator may modulate opr be configured to modulate the carrier signal in a first frequency band and/or a second frequency band according to the first feature. A second signal modulator of the at least one signal modulator may be configured to modulate the carrier signal in a second frequency band, e.g. according to the first feature and/or a second feature different from the first feature.

Modulating the carrier signal with a selected first feature to provide a modulated signal with desired properties may lead to improved tinnitus relief. Further, modulating the carrier signal with different features in different frequency bands provides improved control of the characteristics of the modulated signal which may lead to improved tinnitus relief.

In one or more embodiments, the sound enrichment system can be provided with a microphone for conversion of an acoustic sound signal into an electric signal. The sound signals in the surrounding environment can thereby be analyzed and/or processed.

The electric signal can also be adjusted for compensation of a hearing loss of the user and converted to an acoustic output signal that during use of the sound enrichment system is presented to the user. Such an adjustment can typical take place digitally by a digital signal processor. Accordingly, the sound enrichment system may be configured to adjust the electrical signal for compensation of a hearing loss of the user. The adjusted electrical signal may be converted to an acoustic output signal that during use of the sound enrichment system is presented to the user, e.g. the sound enrichment system may be configured to convert the adjusted electrical signal to an acoustic output signal.

In one or more embodiments, the first feature is selected from a set of features, e.g. according to a user input.

The at least one feature, e.g. the first feature and/or the second feature may comprise amplitude modulation parameters indicative of the modulated signal and the at least one signal modulator, e.g. the first signal modulator and/or the second signal modulator, is configured to modulate the carrier signal by amplitude modulation.

The modulated signal may be a natural sound signal. The modulated signal may be a pink noise signal (1/f-noise) or a signal having decreasing sound pressure levels with increasing frequency at least within a first frequency range and/or a second frequency range. The modulated signal may be a signal having generally increasing sound pressure levels with increasing frequency for low frequencies, for example for frequencies less than 125 Hz. The modulated signal may have a substantially flat sound pressure spectrum (±3 dB) for a selected frequency range, e.g. for frequencies in the range from 250 Hz to 1 kHz. The modulated signal may be a signal having decreasing sound pressure levels with increasing frequency for selected frequencies or at least for frequencies larger than 2 kHz.

The signal generator may be a noise signal generator for provision of a noise carrier signal. The noise signal generator may be configured to provide a white noise carrier signal, a pseudo white noise carrier signal, a pink noise carrier signal or a pseudo pink noise signal.

The modulated signal may comprise a random or pseudo-random component, e.g. in order to provide a varying modulated signal.

The modulation of the carrier signal may be performed in a first frequency band including the first frequency and in a second frequency band including the second frequency.

In one or more embodiments, the sound enrichment system may be configured to perform the modulation in at least one frequency band including a first frequency band.

The sound enrichment system may comprise a filter bank. The filter bank can comprise warped filters for filtering the carrier signal into a number of frequency bands, e.g. including a first frequency band and/or a second frequency band.

The at least one feature including the first feature may be stored in the memory during fitting or manufacturing of the sound enrichment system. A part of a feature, e.g. a gain value may be stored or coded into a signal modulator during manufacture or during fitting of the sound enrichment system.

Since many persons that suffer from tinnitus also suffer from a hearing loss, the sound enrichment system according to a preferred embodiment of the disclosure forms part of a hearing aid. Hereby, the hearing aid may be able to account for both the hearing loss of a user as well as providing relief for a user's perceived tinnitus. In this embodiment, the output transducer of the hearing aid is the same as the output transducer of the sound enrichment system.

Another aspect of the disclosure relates to a binaural hearing aid system comprising a first and a second hearing aid (two hearing aids), wherein the first hearing aid and/or the second hearing aid comprises a sound enrichment system according to the present disclosure. Preferably, both the first and the second hearing aid in the binaural hearing aid system comprise a sound enrichment system according to the present disclosure.

In one or more embodiments, the two hearing aids of the binaural hearing aid system are operatively connected to each other, and some or all potential modulations may be performed in a synchronized manner between the two hearing aids.

In one or more embodiments, the modulation with a first feature in the first hearing aid may be in phase and/or synchronized in time relative to the modulation with a second feature in the second hearing aid. Such a synchronous relation between the modulation together with frequency band pass filtering may make it sound much like listening to breaking waves, as if the user of the binaural hearing aid system is standing on a beach and listening to the waves. Hereby, an even more comfortable signal for tinnitus relief is provided for.

In accordance with some embodiments, a sound enrichment system for provision of tinnitus relief to a user, the sound enrichment system includes: a signal generator for provision of a carrier signal; at least one signal modulator including a first signal modulator for modulation of the carrier signal to a modulated signal; an output transducer for conversion of the modulated signal to an acoustic signal for presentation to the user; and a memory configured to store at least one feature including a first feature; wherein the at least one signal modulator is configured to modulate the carrier signal according to the at least one feature such that the acoustic signal converted from the modulated signal resembles a natural sound signal for the user.

In one or more embodiments, the modulated signal has a first sound pressure level at a first frequency, and a second sound pressure level less than the first pressure level, and wherein the second sound pressure is at a second frequency larger than the first frequency.

In one or more embodiments, the at least one signal modulator is configured to modulate the carrier signal according to the at least one feature such that the modulated signal has a third sound pressure level less than the second pressure level, the third sound pressure being at a third frequency larger than the second frequency.

In one or more embodiments, a sound pressure level of the modulated signal is a substantially decreasing function of frequency for frequencies larger than a first threshold frequency.

In one or more embodiments, a sound pressure level of the modulated signal is a substantially increasing function of frequency for frequencies smaller than a second threshold frequency.

In one or more embodiments, the sound enrichment system further includes a microphone for conversion of an acoustic sound signal into an electric signal.

In one or more embodiments, the sound enrichment system further includes circuitry for adjusting the electric signal for compensation of a hearing loss of the user and for conversion of the adjusted electric signal to an acoustic output signal for presentation to the user.

In one or more embodiments, the first feature comprises an amplitude modulation parameter, and the signal modulator is configured to modulate the carrier signal by amplitude modulation.

In one or more embodiments, the modulated signal comprises a natural sound signal.

In one or more embodiments, the signal generator comprises a noise signal generator for provision of a noise carrier signal as the carrier signal.

In one or more embodiments, the modulated signal comprises a random or pseudo-random component.

In one or more embodiments, the modulated signal has a first sound pressure level at a first frequency, and a second sound pressure level less than the first pressure level, and wherein the second sound pressure is at a second frequency larger than the first frequency; and the at least one signal modulator is configured to perform the modulation in a first frequency band including the first frequency and in a second frequency band including the second frequency.

In accordance with other embodiments, a binaural hearing aid system includes a first hearing aid and a second hearing aid, wherein the first hearing aid comprises a first sound enrichment system according to claim 1, and the second hearing aid comprises a second sound enrichment system according to claim 1, wherein the first sound enrichment system and the second sound enrichment system are synchronized in time.

In one or more embodiments, the first sound enrichment system is configured to perform a first signal modulation based on a first feature, and the second sound enrichment system is configured to perform a second signal modulation based on a second feature, and wherein the first signal modulation and the second signal modulation are synchronized between the first and second sound enrichment systems.

In accordance with other embodiments, a method for provision of tinnitus relief to a user, includes: generating a carrier signal in a sound enrichment system that is configured to be worn by the user; modulating the carrier signal with at least one feature including a first feature, thereby forming a modulated signal; and converting the modulated signal to an acoustic signal for presentation to the user; wherein the act of modulating the carrier signal comprises retrieving the least one feature from a memory of the sound enrichment system; and wherein the carrier signal is modulated such that the acoustic signal converted from the modulated signal resembles a natural sound signal for the user.

DESCRIPTION OF THE DRAWING FIGURES

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting in the scope of the claims.

Figure 2:
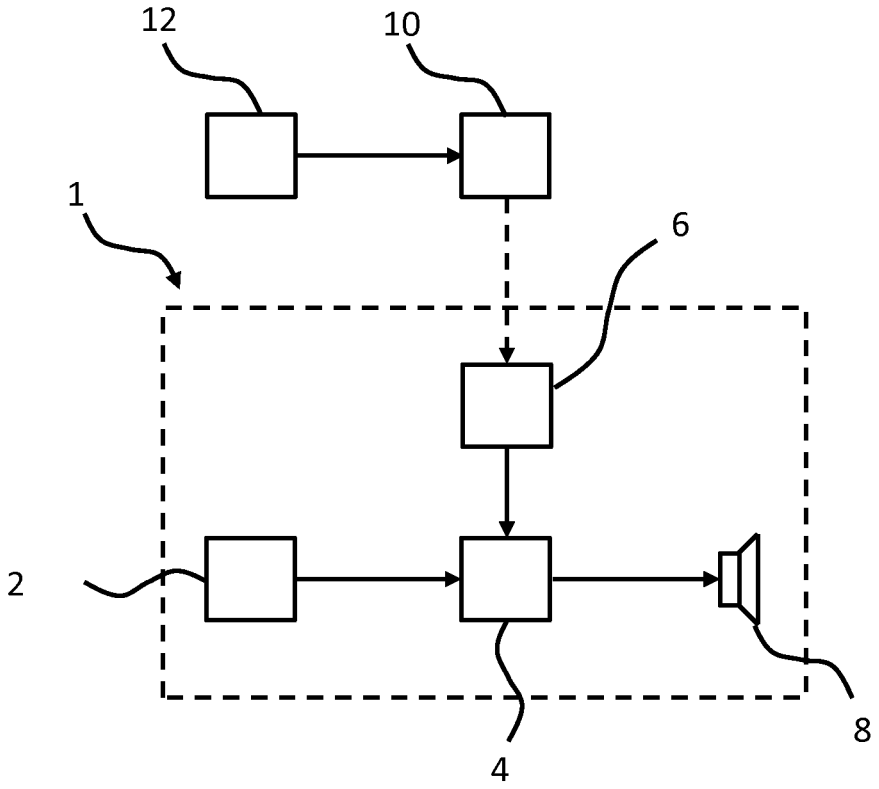
Figure 3:
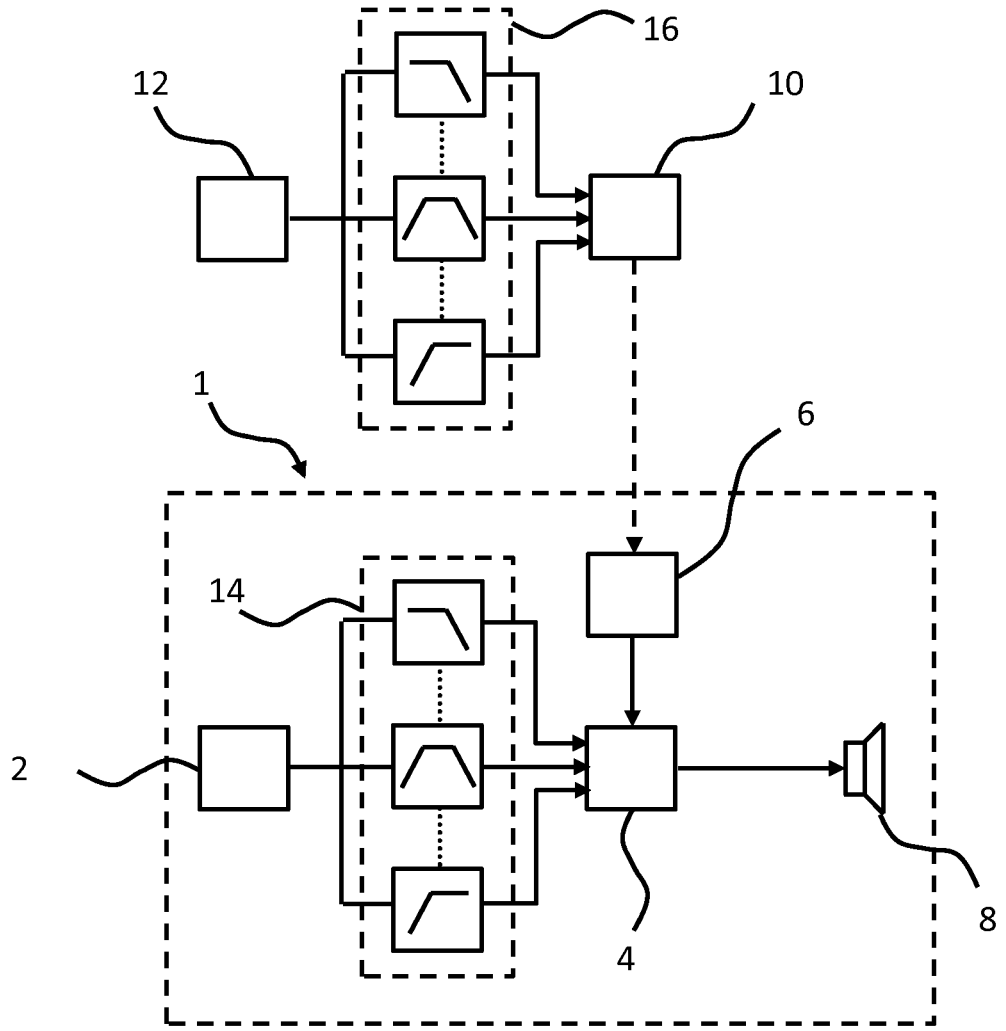
Figure 4:
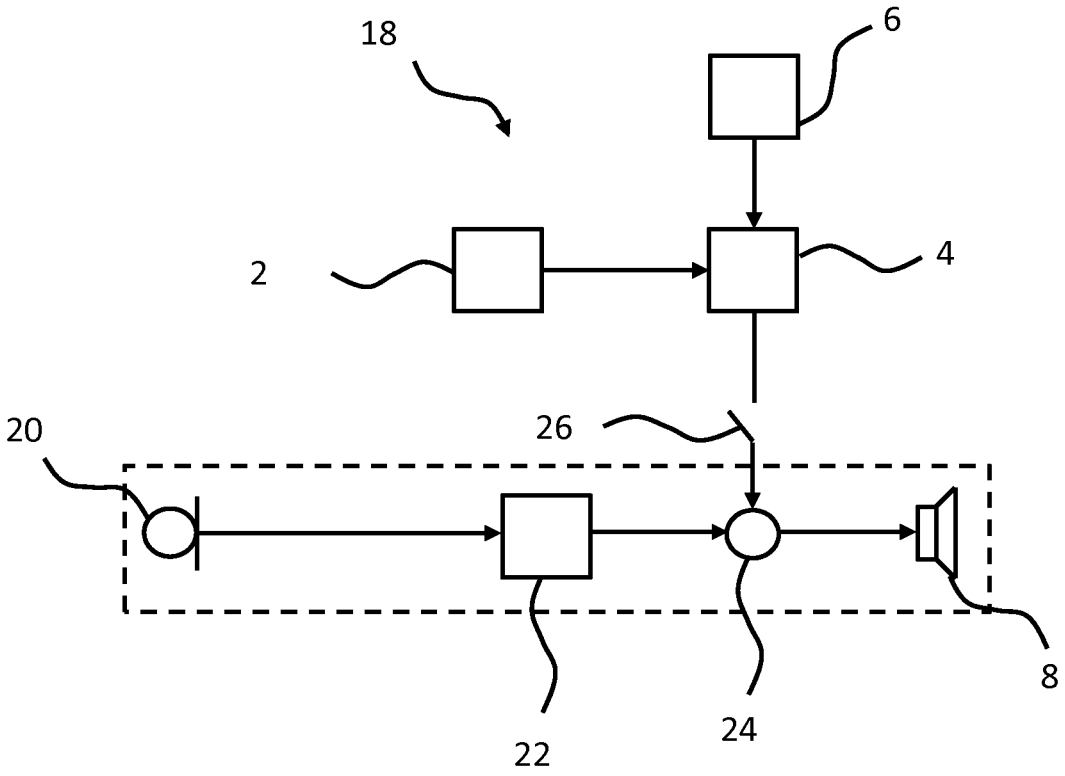
Figure 5:
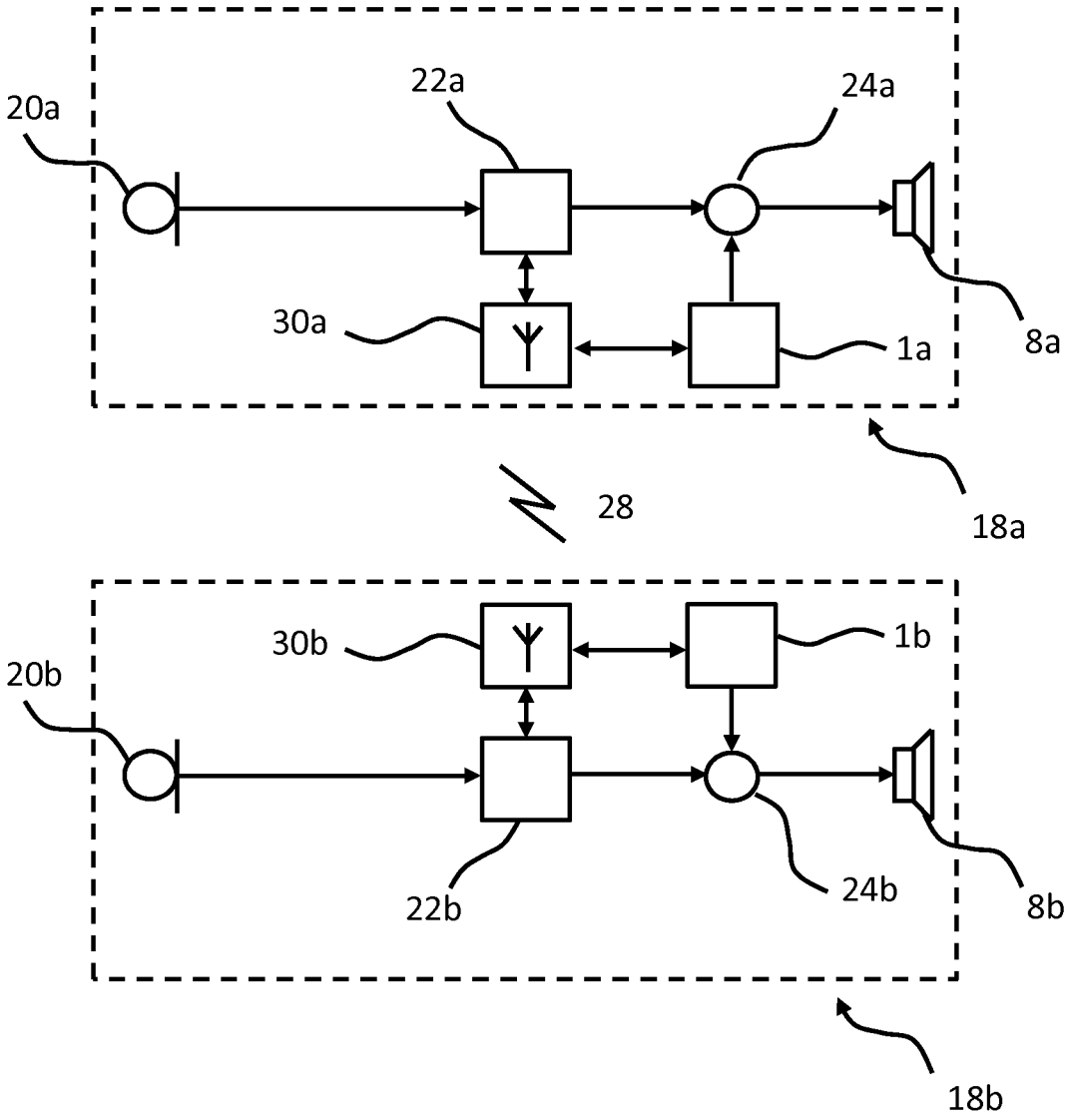

FIG. 1 shows a simplified block diagram of a sound enrichment system according to the present disclosure, FIG. 2 is a block diagram illustrating the sound enrichment system in a fitting situation, FIG. 3 is a block diagram illustrating an alternative embodiment of a sound enrichment system according to the present disclosure, FIG. 4 schematically illustrates a sound enrichment system forming part of a hearing aid according to the present disclosure, and FIG. 5 schematically illustrates a binaural hearing aid system according to the present disclosure.

DETAILED DESCRIPTION

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The at least one signal modulator is configured to modulate the carrier signal according to the at least one feature such that the modulated signal has a number of different sound pressure levels at different frequencies and/or different frequency areas.

Table 1 and Table 2 below shows exemplary combinations of frequencies/frequency bands and sound pressure levels of the modulated signal according to some embodiments.

TABLE 1

| Embodiment | $f_1$ | $P_1$ | $f_2$ | $P_2$ | $f_3$ | $P_3$ |
|---|---|---|---|---|---|---|
| A | 500 Hz | $P_1$ | 1 kHz | ~$P_1$ | 4 kHz | <0.9 $P_1$ |
| B | 2 kHz | $P_1$ | 4 kHz | <0.9 $P_1$ | 8 kHz | <0.5 $P_1$ |

TABLE 2

| Embodiment | $F_1$ | $P_1$ | $F_2$ | $P_2$ | $F_3$ | $P_3$ |
|---|---|---|---|---|---|---|
| A | 25-125 Hz | $P_1$ | 125 Hz-2 kHz | >1.1 $P_1$ | 2 kHz-8 kHz | <0.9 $P_2$ |

FIG. 1 shows a simplified block diagram of a sound enrichment system 1 according to the present disclosure. The sound enrichment system 1 has a signal generator 2 for provision of a carrier signal and a first signal modulator 4 for modulation of the carrier signal to a modulated signal.

The sound enrichment system 1 further has an output transducer 8 for conversion of the modulated signal to an acoustic signal. The acoustic signal is presented to the user during use of the sound enrichment system 1.

Also shown is a memory 6 for storing at least one feature including a first feature. In the illustrated embodiment, the first feature comprises amplitude modulation parameters.

The first signal modulator 4 is configured to apply one or more features stored in the memory 6 to the carrier signal generated by the signal generator 2.

In an exemplary embodiment, the signal generator 2 is a noise signal generator for provision of a noise carrier signal.

FIG. 2 is a block diagram illustrating the sound enrichment system 1 shown in FIG. 1 wherein the sound enrichment system is in a fitting situation, i.e. a situation where the sound enrichment system is connected to a fitting instrumentation, such as a computer (PC). The first feature may be extracted from a sound signal recorded in nature and stored on a recordable medium 12 such as a compact disc (CD) or flash memory.

Alternatively, a second signal generator (not shown) may be configured to provide an artificial generated natural sound signal. To ensure that such a signal is suitable for tinnitus relief, the generated signal can be converted by an electro acoustic transducer (not shown) to an acoustic signal and presented to a user. The user can hereby provide feedback on how the artificially generated signal is perceived.

The natural sound signal is applied to a feature extractor 10. The extractor 10 is configured to extract at least one feature of the natural sound signal.

In one embodiment of the sound enrichment system, the feature to be extracted can be the amplitude modulation of the natural sound signal. For extraction of the amplitude modulation of the natural sound signal, the extractor 10 samples the natural sound signal over a period of time with a sampling frequency. The sampling frequency together with the period of time in which the natural sound signal is sampled determines the number of samples/amplitude parameter values of the respective feature. For example, sampling ten samples per second over a time period of ten seconds gives 100 feature samples.

The sound enrichment system 1 is then programmed with the samples of the amplitude modulation. During the programming the extractor 10 is connected with the memory 6 via a programming interface. The connection between the extractor 10 and the memory 6 can be wired or wireless. The samples of the extracted amplitude modulation of the natural sound signal is transferred to the memory 6 and the connection between the extractor 10 and the memory 6 is disabled.

During operation of the sound enrichment system 1, the first signal modulator 4 applies the first feature, i.e. the samples of the amplitude modulation of the natural sound signal to the carrier signal generated by the signal generator 2. Each sample is applied to the carrier signal a time span from the previous feature.

In an alternative embodiment of the sound enrichment system the feature to be extracted may be a spectral characteristic of the natural sound signal such as the frequency modulation. For extraction of the frequency modulation the extractor comprises a frequency modulation extractor (not shown).

The extractor 10 may extract more than one feature of a natural sound signal. As an example the extractor 10 extracts a first feature being the amplitude modulation of the natural sound signal and a second feature being the frequency modulation of the natural sound signal. The extracted features are communicated to the memory 6 for storing in the sound enrichment system. Thus, the memory 6 may comprise the amplitude modulation as a first feature and the frequency modulation as a second feature.

When more than one feature is provided in the memory 6 of the sound enrichment system 1, the sound enrichment system 1 can be provided with a control or function (not shown) configured to select between a number of programs using different feature configurations or settings and wherein in a first program state the first signal modulator 4 e.g. applies the first feature (e,g, amplitude modulation of the natural sound signal to the carrier signal) and in a second program state the signal modulator applies the second feature (e.g. frequency modulation of the natural sound signal) to the carrier signal. The control or function for selecting can also be implemented on a remote control for the sound enrichment system 1. The remote control can be a smart phone.

The extractor 10 may also extract one or more features from a selection of natural sound signals. As an example the extractor 10 is presented with a first natural sound signal and a second natural sound signal.

The extractor 10 is configured to extract at least one feature of the first natural sound signal and at least one feature of the second natural sound signal. A connection is then established between the extractor 10 and the memory 6. The feature extracted from the first natural sound signal and the feature extracted from the second natural sound signal are transferred to the memory 6.

In one or more exemplary embodiments, the sound enrichment system 1 further comprises an environment classifier (not shown) that is adapted to at least in part classify the ambient sound environment and wherein the first signal modulator 4 may be configured to apply a feature of a natural sound signal in dependence of the classification of the ambient sound environment. For example, the modulation may be performed in dependence of what kind of noise or sound signals that are already present in the ambient sound environment. In one ambient sound environment a feature indicative of a natural sound signal is applied to the carrier signal and in another ambient sound environment a feature indicative of another natural sound signal is applied to the carrier signal.

FIG. 3 is a block diagram illustrating an alternative embodiment of the sound enrichment system 1 shown in FIG. 1 wherein the modulation of the carrier signal takes place in a number of frequency bands.

During the programming of the sound enrichment system, the natural sound signal is applied to a first filter bank 16. The first filter bank 16 can comprise any number of bands from one band up to N bands. In an exemplary embodiment the first filter bank 16 comprises a low pass filter for provision of a low pass filtered natural sound signal, a band pass filter for provision of a band pass filtered natural sound signal and a high pass filter for provision of a high pass filtered natural sound signal.

Each frequency band of the natural sound signal is then applied to the feature extractor 10. The feature extractor 10 is configured to extract a feature of a number of the bands of the natural sound signal. For example the feature extractor 10 can be configured to extract a feature of each band of the natural sound signal. The extracted feature for each band of the natural sound signal is then transferred to the memory 6.

During operation of the sound enrichment system, the carrier signal generated by the signal generator 2 is applied to a second filter bank 14. The second filter bank 14 can comprise any number of bands. In an exemplary embodiment the second filter bank 14 comprises a low pass filter for provision of a low pass filtered carrier signal, a band pass filter for provision of a band pass filtered carrier signal and a high pass filter for provision of a high pass filtered carrier signal.

Each of the bands of the carrier signal is then applied to the first signal modulator 4. The first signal modulator 4 is configured to apply the feature of a frequency band of the natural sound signal to the corresponding frequency band of the carrier signal.

In an embodiment of the sound enrichment system where the first filter bank 14 and the second filter banks 16 are identical, the feature extracted for the n'th band of the natural sound signal is applied to the n'th band of the carrier signal.

The environment classifier can be connected to the second filter bank 14 and/or the first signal modulator 4 for control of the band modulation in dependence of an ambient sound environment.

FIG. 4 shows a hearing aid 18 with a sound enrichment system for the provision of tinnitus relief.

The hearing 18 comprises the signal generator 2 for provision of a carrier signal and the first signal modulator 4 for modulation of the carrier signal to a modulated signal. The sound enrichment system also comprises the memory 6 for storing at least one feature indicative of a natural sound signal.

The hearing aid 18 also comprises a microphone 20 for conversion of an acoustic sound signal into an electric signal. The electric signal is provided to a digital signal processor (DSP) 22 for provision of a compensated signal. The DSP is programmed to adjust the electric signal for compensation of a hearing loss of the user. The signal generator 2, the memory 6 and the first signal modulator 4 can be implemented as separate parts or as an integral part in the processor 22.

The hearing aid 18 further comprises an adder 24 for provision of an added signal. The adder 24 ads the compensated signal and the modulated signal. The output transducer 8 converts the added signal to an acoustic output signal that during use of the hearing aid 18 is presented to the user. The output transducer 8 in an exemplary embodiment is a receiver. The adder 24 can also be implemented as separate parts or as an integral part in the processor 22.

The hearing aid 18 can be provided with a control or function 26 configured to select between a first program state of the hearing aid 18 where the modulated signal is added to the compensated electric signal and a second program state of the hearing aid 18 where the modulated signal is not added to the compensated electric signal. The control or function for selecting can also be implemented on a remote control for the sound enrichment system 1. The remote control can be a smart phone.

The control 26 can be connected with an environment classifier for provision of an automatic switch. In one ambient sound environment the environment classifier sets the switch in an off position such that no signal for tinnitus relief is added to the compensated signal and in another ambient sound environment the environment classifier sets the switch in an on position such that a signal for tinnitus relief is presented to the user.

FIG. 5 shows a binaural hearing aid system. The binaural hearing aid system comprises a first hearing aid 18*a* and a second hearing aid 18*b*.

The first hearing 18*a* comprises a first sound enrichment system 1*a* having a first signal generator (not shown) for provision of a first carrier signal, a first signal modulator (not shown) for modulation of the first carrier signal to a first modulated signal and a first memory (not shown) for storing at least one feature of a natural sound signal.

The first hearing aid 18*a* also comprises a first microphone 20*a* for conversion of an acoustic sound signal into a first electric signal. The first electric signal is provided to a first digital signal processor (DSP) 22*a* for provision of a first compensated signal.

The first hearing aid further comprises a first adder 24*a* for provision of a first added signal. The first adder 24*a* ads the first compensated signal and the first modulated signal. A first receiver 8*a* converts the first added signal to an acoustic output signal that during use of the first hearing aid 18*a* is presented to the user.

The second hearing 18*a* comprises a second sound enrichment system 1*b* having a second signal generator (not shown) for provision of a second carrier signal, a second signal modulator (not shown) for modulation of the second carrier signal to a second modulated signal and a second memory (not shown) for storing at least one feature of a natural sound signal.

The second hearing aid 18*b* also comprises a second microphone 20*b* for conversion of an acoustic sound signal into a second electric signal. The second electric signal is provided to a second digital signal processor (DSP) 22*b* for provision of a second compensated signal.

The second hearing aid further comprises a second adder 24*b* for provision of a second added signal. The second adder 24*b* ads the second compensated signal and the second modulated signal. A second receiver 8*b* converts the second added signal to an acoustic output signal that during use of the second hearing aid 18*b* is presented to the user.

The binaural hearing aid system comprises a link 28 between the two individual hearing aids. The link 28 is preferably wireless, but may in another embodiment be wired. A wireless link is established with a first transceiver 30*a* connected to the first DSP 22*a* and a second transceiver 30*b* connected to the second DSP 22*b*.

The link 28 enables at least one of the two hearing aids to communicate with the other, i.e. it may be possible to send information from at least one of the two hearing aids via the link 28 to the other of the two hearing aids. In a preferred embodiment, the link 28 enables the two hearing aids to communicate with each other. The link 28, thus, enables the two digital signal processors, to perform binaural signal processing. Moreover, the link 28 enables the two hearing aids to perform the modulations of the carrier signals generated in the two hearing aids in a coordinated manner. At least one of the hearing aids comprises a sound enrichment system. Preferably, both of the hearing aids comprise a sound enrichment system.

In a preferred embodiment of the disclosure, the first and second hearing aids are the hearing aid shown in FIG. 4. Hereby, it is achieved that the modulations of the carrier signal may furthermore be performed in a coordinated, possibly asynchronous, manner between the two hearing aids. In this way, the stereo perception of the tinnitus enrichment system can be maintained.

The modulations of the carrier signal may even be shifted between the two hearing aids. After a certain time span the roles of the two hearing aids may be reversed. This shifting between the modes of the two hearing aids may continue as long as they are turned on, and the time span between the shifting may also be a randomly determined time span, or even be a time span that is modulated by another signal.

In an embodiment of the binaural hearing aid system, the two hearing aids are configured to operate in a master-slave configuration wherein only one of the two hearing aids comprises a sound enrichment system. Hereby is achieved an embodiment wherein all the signal processing associated with the generation and modulation of the carrier signal and the classification of the sound environment may be done in only one of the two hearing aids, and wherein the thus modulated carrier signal may simply be transferred to the other via the link 28.

However, in a preferred embodiment, both hearing aids may comprise a sound enrichment system. Hereby is achieved that only signals used to control the sound enrichment system may need to be transferred from the master to the slave. This will lead to a considerable saving of the energy usage, because it may require at least five times as much battery power to transfer the noise signals itself from the master to the slave.

Although particular embodiments have been shown and described, it will be understood that they are not intended to limit the present inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A sound system for provision of tinnitus relief to a user, the sound system comprising:

a signal generator for provision of a noise signal, wherein the signal generator comprises a noise generator;

at least one signal modulator for modulation of the noise signal to obtain a modulated signal;

an output transducer for conversion of the modulated signal to an acoustic signal for presentation to the user; and a memory configured to store data, the data having different values corresponding respectively with at least a first sound pressure level and a second sound pressure level;

wherein the at least one signal modulator is configured to modulate the noise signal based on the data that corresponds with the at least first and second sound pressure levels to obtain the modulated signal; and wherein the modulated signal has the first sound pressure level at a first frequency, and the second sound pressure level less than the first level, and wherein the second sound pressure level is at a second frequency different from the first frequency.

2. The sound system according to claim 1, wherein the modulated signal has a third sound pressure level less than the second sound pressure level, the third sound pressure level being at a third frequency larger than the second frequency.

3. The sound system according to claim 1, wherein a level of the modulated signal is a decreasing function of frequency for frequencies larger than a threshold frequency.

4. The sound system according to claim 1, wherein a level of the modulated signal is an increasing function of frequency for frequencies smaller than a threshold frequency.

5. The sound system according to claim 1, further comprising a microphone for conversion of an acoustic sound signal into an electric signal.

6. The sound system according to claim 5, further comprising circuitry for adjusting the electric signal for compensation of a hearing loss of the user.

7. The sound system according to claim 1, wherein the data comprises an amplitude modulation parameter, and the signal modulator is configured to modulate the noise signal by amplitude modulation.

8. The sound system according to claim 1, wherein the modulated signal comprises a natural sound characteristic.

9. The sound system according to claim 1, wherein the at least one signal modulator is configured to perform the modulation in a first frequency band including the first frequency and in a second frequency band including the second frequency.

10. A binaural hearing aid system comprising a first hearing aid and a second hearing aid, wherein the first hearing aid comprises a first sound system according to claim 1, and the second hearing aid comprises a second sound system, wherein the first sound system and the second sound system are synchronized in time.

11. The binaural hearing aid system according to claim 10, wherein the first sound system is configured to perform a first signal modulation based on a first feature, and the second sound system is configured to perform a second signal modulation based on a second feature, and wherein the first signal modulation and the second signal modulation are synchronized between the first and second sound systems.

12. The sound system according to claim 1, wherein the memory comprises a hearing aid memory.

13. The sound system according to claim 1, wherein the acoustic signal has a sound characteristic like that of breaking waves.

14. The sound system according to claim 1, wherein the acoustic signal has a sound characteristic like that of flowing water, waterfall, or rainforest.

15. The sound system according to claim 1, wherein the data is determined during fitting of the hearing aid or during a manufacturing process of the hearing aid.

16. The sound system according to claim 1, wherein the data is associated with a natural sound, and wherein the at least one signal modulator is configured to modulate the noise signal based on the data that is associated with the natural sound to obtain the modulated signal.

17. The sound system according to claim 1, wherein the data is indicative of a characteristic of a natural sound, and wherein the at least one signal modulator is configured to modulate the noise signal based on the data that is indicative of the characteristic of the natural sound to obtain the modulated signal.

18. The sound system according to claim 1, wherein the acoustic signal has a characteristic of an ocean wave.

19. The sound system according to claim 1, wherein the acoustic signal has a characteristic of a breaking wave.

20. The sound system according to claim 1, wherein the acoustic signal mimics a sound of an ocean wave.

21. The sound system according to claim 1, wherein the acoustic signal mimics a sound of a breaking wave.

22. The sound system according to claim 1, wherein the data comprises an amplitude modulation parameter.

23. The sound system of claim 1, wherein the at least one signal modulator is configured to modulate the noise signal so that the noise signal has varying volumes over time.

24. A method for provision of tinnitus relief to a user, comprising:

retrieving data from a memory of a sound system, the data having different values corresponding respectively with at least a first sound pressure level and a second sound pressure level;

generating a noise signal in the sound system that is configured to be worn by the user;

modulating the noise signal based on the data that corresponds with the at least first and second sound pressure levels, thereby forming a modulated signal; and converting the modulated signal to an acoustic signal for presentation to the user;

wherein the modulated signal has the first level at a first frequency, and the second level less than the first level, and wherein the second level is at a second frequency different from the first frequency.

25. The method according to claim 24, wherein the memory comprises a hearing aid memory.

26. The method according to claim 24, wherein the data is determined during fitting of the hearing aid or during a manufacturing process of the hearing aid.

27. The method according to claim 24, wherein the data is associated with a natural sound.

28. The method according to claim 24, wherein the data is indicative of a characteristic of a natural sound.

29. The method according to claim 24, wherein the acoustic signal has a characteristic of an ocean wave.

30. The method according to claim 24, wherein the acoustic signal has a characteristic of a breaking wave.

31. The method according to claim 24, wherein the acoustic signal mimics a sound of an ocean wave.

32. The method according to claim 24, wherein the acoustic signal mimics a sound of a breaking wave.

33. The method of claim 24, wherein the act of modulating the noise signal is performed so that has varying volumes over time.

34. A sound system for provision of tinnitus relief to a user, the sound system comprising:

a noise generator for provision of a noise signal;

a signal modulator for modulation of the noise signal based on stored data to obtain a modulated noise signal, the stored data having different values corresponding respectively to one or more sound pressure level(s); and an output transducer for conversion of the modulated noise signal to an acoustic signal for presentation to the user;

wherein the noise signal comprises a white noise signal or a color noise signal.

35. The sound system according to claim 34, wherein the modulated noise signal has different frequencies.

36. The sound system according to claim 34, wherein the data comprises pre-determined data.

37. The sound system according to claim 34, wherein the acoustic signal has a sound characteristic like that of breaking waves.

38. The sound system according to claim 34, wherein the modulated signal has a first level at a first frequency, and a second level less than the first level, and wherein the second level is at a second frequency larger than the first frequency.

39. The sound system according to claim 38, wherein the modulated signal has a third level less than the second level, the third level being at a third frequency larger than the second frequency.

40. The sound system according to claim 38, wherein the signal modulator is configured to perform the modulation in a first frequency band including the first frequency, and in a second frequency band including the second frequency.

41. The sound system according to claim 34, wherein a level of the modulated signal is a decreasing function of frequency for frequencies larger than a threshold frequency.

42. The sound system according to claim 34, wherein a level of the modulated signal is an increasing function of frequency for frequencies smaller than a threshold frequency.

43. The sound system according to claim 34, further comprising a microphone for conversion of an acoustic sound signal into an electric signal.

44. The sound system according to claim 43, further comprising circuitry for adjusting the electric signal for compensation of a hearing loss of the user.

45. The sound system according to claim 34, wherein the signal modulator is configured to modulate the noise signal by amplitude modulation.

46. The sound system according to claim 45, wherein the signal modulator is configured to modulate the noise signal based on an amplitude modulation parameter.

47. The sound system according to claim 34, wherein the signal modulator is configured for modulation of the noise signal to obtain the modulated noise signal in accordance with a pre-determined scheme.

48. A binaural hearing aid system comprising a first hearing aid and a second hearing aid, wherein the first hearing aid comprises a first sound system according to claim 34, and the second hearing aid comprises a second sound system, wherein the first sound system and the second sound system are synchronized in time.

49. The binaural hearing aid system according to claim 48, wherein the first sound system is configured to perform a first signal modulation based on a first feature, and the second sound system is configured to perform a second signal modulation based on a second feature, and wherein the first signal modulation and the second signal modulation are synchronized between the first and second sound systems.

50. The sound system according to claim 34, further comprising a memory for storing the data.

51. The sound system according to claim 50, wherein the memory comprises a hearing aid memory.

52. The sound system according to claim 34, wherein the signal modulator is configured to modulate the noise signal in a random or pseudo-random manner.

53. The sound system according to claim 34, wherein the data is associated with a natural sound.

54. The sound system according to claim 34, wherein the data is indicative of a characteristic of a natural sound.

55. The sound system according to claim 34, wherein the data comprises an amplitude modulation parameter.

56. The sound system according to claim 34, wherein the acoustic signal mimics a sound of an ocean wave.

57. The sound system according to claim 34, wherein the acoustic signal mimics a sound of a breaking wave.

58. The sound system according to claim 34, wherein the acoustic signal has an ocean wave characteristic.

59. The sound system of claim 34, wherein the signal modulator is configured to modulate the noise signal so that the noise signal has varying volumes over time.

60. A hearing aid comprising:

a signal generator for provision of a noise signal;

at least one signal modulator coupled to the signal generator, the at least one signal modulator configured to perform amplitude modulation to provide a modulated signal;

an output transducer for conversion of the modulated signal to an acoustic signal for presentation to a user; and a memory storing data, wherein the data has different values that corresponds respectively with one or more sound pressure level(s);

wherein the at least one signal modulator is configured to perform the amplitude modulation according to the data that corresponds with the one or more sound pressure level(s).

61. The hearing aid according to claim 60, wherein the data is associated with a natural sound.

62. The hearing aid according to claim 60, wherein the data is indicative of a characteristic of a natural sound.

63. The hearing aid according to claim 60, wherein the data comprises an amplitude modulation parameter.

64. The hearing aid according to claim 60, wherein the data is stored in the memory during fitting of the hearing aid.

65. The hearing aid according to claim 60, wherein the data is stored in the memory during a manufacturing process of the hearing aid.

66. The hearing aid according to claim 60, wherein the data in the memory is selected during fitting of the hearing aid.

67. The hearing aid according to claim 60, wherein the acoustic signal has a characteristic of an ocean wave.

68. The hearing aid according to claim 60, wherein the acoustic signal has a characteristic of a breaking wave.

69. The hearing aid according to claim 60, wherein the acoustic signal mimics a sound of an ocean wave.

70. The hearing aid according to claim 60, wherein the acoustic signal mimics a sound of a breaking wave.

71. The hearing aid of claim 60, wherein the at least one signal modulator is configured to perform the amplitude modulation so that the noise signal has varying volumes over time.

72. A method for provision of tinnitus relief to a user, comprising:

retrieving data having different values from a memory, wherein the data corresponds with at least a first sound pressure level and a second sound pressure level;

generating a noise signal in a hearing device that is configured to be worn by the user;

modulating the noise signal based on the data, thereby forming a modulated signal, wherein the modulated signal comprises different signal levels that correspond respectively with the values of the data in the memory; and converting the modulated signal to an acoustic signal for presentation to the user;

wherein the data is determined during fitting of the hearing device or during a manufacturing process of the hearing device.

73. The method according to claim 72, wherein the noise signal is modulated so that the acoustic signal has the first sound pressure level and the second sound pressure level.

74. The method according to claim 72, wherein the data is associated with a natural sound.

75. The method according to claim 72, wherein the data is indicative of a characteristic of a natural sound.

76. The method according to claim 72, wherein the acoustic signal has a characteristic of an ocean wave.

77. The method according to claim 72, wherein the acoustic signal has a characteristic of a breaking wave.

78. The method according to claim 72, wherein the acoustic signal mimics a sound of an ocean wave.

79. The method according to claim 72, wherein the acoustic signal mimics a sound of a breaking wave.

80. The method of claim 72, wherein the act of modulating the noise signal is performed so that the noise signal has varying volumes over time.

* * * * *